US007916102B2

(12) United States Patent
Chung et al.

(10) Patent No.: US 7,916,102 B2
(45) Date of Patent: Mar. 29, 2011

(54) PIXEL AND ORGANIC LIGHT EMITTING DISPLAY DEVICE INCLUDING THE SAME

(75) Inventors: Bo-Yong Chung, Yongin (KR); Chul-Kyu Kang, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 0 days.

(21) Appl. No.: 12/612,644

(22) Filed: Nov. 4, 2009

(65) Prior Publication Data

US 2010/0220038 A1 Sep. 2, 2010

(30) Foreign Application Priority Data

Feb. 27, 2009 (KR) ..... 10-2009-0016733

(51) Int. Cl.
*G09G 3/32* (2006.01)

(52) U.S. Cl. ..... 345/82; 345/76

(58) Field of Classification Search ..... 345/82, 345/83, 76–80; 315/169.1–169.4
See application file for complete search history.

(56) References Cited

FOREIGN PATENT DOCUMENTS

KR 1020080000468 A 1/2008
KR 1020080067856 A 7/2008

*Primary Examiner* — Ricardo L Osorio
(74) *Attorney, Agent, or Firm* — Christie, Parker & Hale, LLP

(57) ABSTRACT

A pixel includes: an organic light emitting diode coupled between a first power supply and a second power supply; a first transistor coupled between the organic light emitting diode and the second power supply; a second transistor coupled to a first node to which a gate electrode of the first transistor is coupled; a first capacitor coupled between the first node and a second node; a third transistor coupled between the second node and a data line; a fourth transistor coupled between the first node and the second node; a fifth transistor coupled between the first transistor and the second power supply; and a second capacitor coupled between the second node and a third node between the first transistor and the fifth transistor.

19 Claims, 4 Drawing Sheets

PIXEL AND ORGANIC LIGHT EMITTING DISPLAY DEVICE INCLUDING THE SAME

CROSS-REFERENCE TO RELATED APPLICATIONS

This application claims priority to and the benefit of Korean Patent Application No. 10-2009-0016733, filed on Feb. 27, 2009 in the Korean Intellectual Property Office, the entire content of which is incorporated herein by reference.

BACKGROUND

1. Field of the Invention

The present invention relates to a pixel of an organic light emitting display device, and an organic light emitting display device including the same.

2. Discussion of Related Art

Recently, various flat panel display devices having reduced weight and volume when compared to cathode ray tubes have been developed. Flat panel display devices include liquid crystal display devices, field emission display devices, plasma display panels, and organic light emitting display devices, among others.

Among these, the organic light emitting display device displays an image using organic light emitting diodes that generate light by the recombination of electrons and holes. Such an organic light emitting display device is driven with low power consumption and rapid response times.

Generally, the organic light emitting display device represents gray levels by controlling the amount of current flowing to the organic light emitting diodes using a driving transistor included in each of pixels. In this case, an image having non-uniform brightness may be displayed due to variations in threshold voltages of the driving transistors included in the pixels.

SUMMARY OF THE INVENTION

Therefore, exemplary embodiments of the present invention provide a pixel that can compensate for the threshold voltage of a driving transistor, and an organic light emitting display device including the same.

According to an exemplary embodiment of the present invention, there is provided a pixel including: an organic light emitting diode coupled between a first power supply and a second power supply, the first power supply having a higher voltage than the second power supply; a first transistor coupled between the organic light emitting diode and the second power supply, and for controlling a driving current that flows from the first power supply to the second power supply via the organic light emitting diode; a second transistor coupled to a first node to which a gate electrode of the first transistor is coupled, and for bringing the first node to a first voltage in accordance with a first scan signal; a first capacitor coupled between the first node and a second node; a third transistor coupled between the second node and a data line, and for supplying a data signal from the data line to the second node in accordance with the first scan signal; a fourth transistor coupled between the first node and the second node, and for coupling the first node to the second node in accordance with a second scan signal; a fifth transistor coupled between the first transistor and the second power supply, and for coupling the first transistor to the second power supply in accordance with an emission control signal; and a second capacitor coupled between the second node and a third node between the first transistor and the fifth transistor.

According to another exemplary embodiment of the present invention, there is provided an organic light emitting display device, including a display region including a plurality of pixels, wherein each of the plurality of pixels includes: an organic light emitting diode coupled between a first power supply and a second power supply, the first power supply having a higher voltage than the second power supply; a first transistor coupled between the organic light emitting diode and the second power supply, and for controlling a driving current that flows from the first power supply to the second power supply via the organic light emitting diode; a second transistor coupled to a first node to which a gate electrode of the first transistor is coupled, and for bringing the first node to a first voltage in accordance with a first scan signal; a first capacitor coupled between the first node and a second node; a third transistor coupled between the second node and a data line, and for supplying a data signal from the data line to the second node in accordance with the first scan signal; a fourth transistor coupled between the first node and the second node, and for coupling the first node to the second node in accordance with a second scan signal; a fifth transistor coupled between the first transistor and the second power supply, and for coupling the first transistor to the second power supply in accordance with an emission control signal; and a second capacitor coupled between the second node and a third node between the first transistor and the fifth transistor.

With the pixel and the organic light emitting display device including the same according to exemplary embodiments of the present invention, the pixel circuit includes relatively fewer transistors, compensates for the threshold voltage of the driving transistor, while improving the image quality and the power consumption of the organic light emitting display device.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
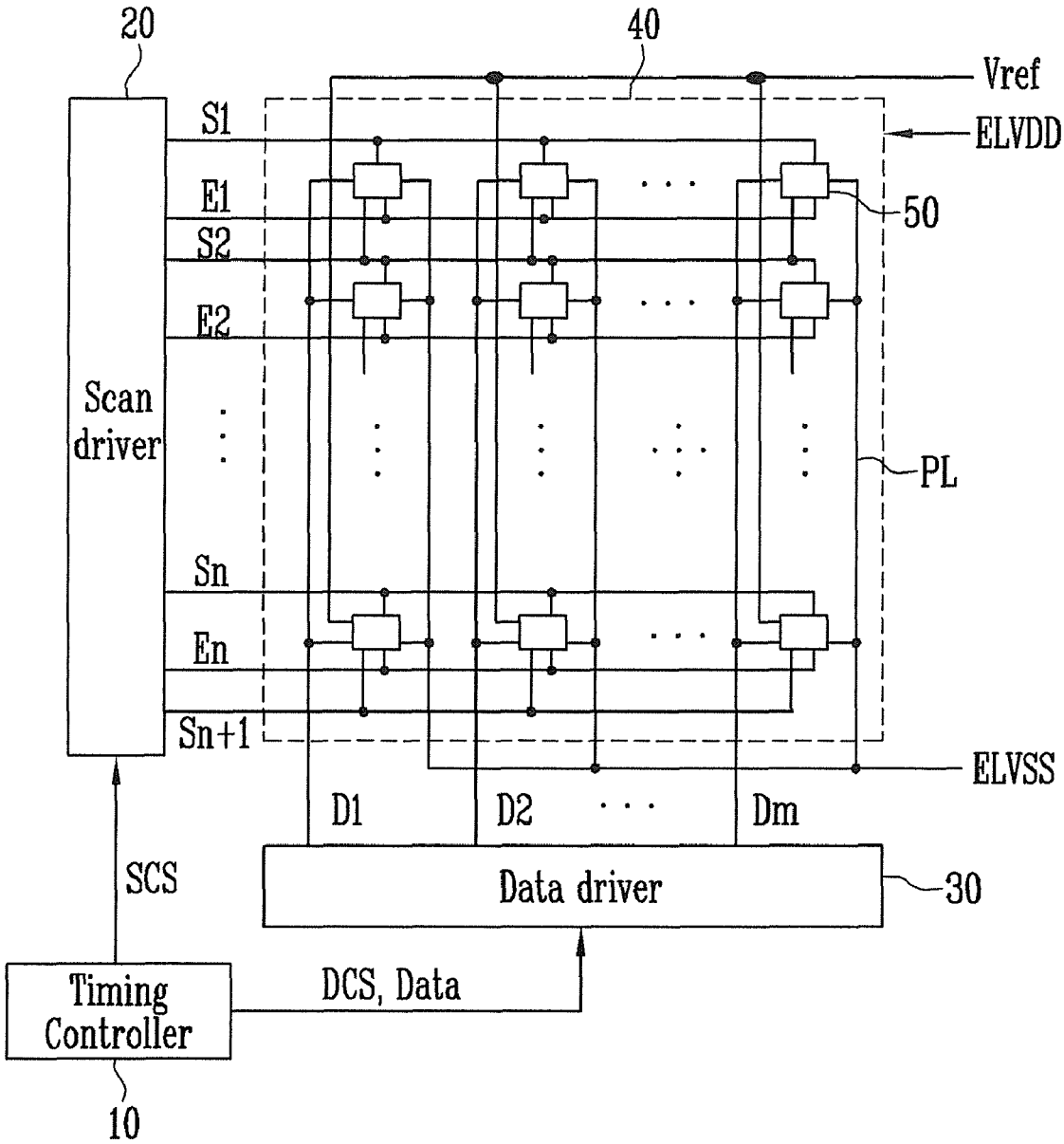
FIG. 1 is a schematic block diagram of an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more additional elements. Further, some of the elements that are not essential to the complete understanding of the invention are omitted for clarity. Also, like reference numerals refer to like elements throughout.

Hereinafter, exemplary embodiments of the present invention will be described in more detail with reference to the accompanying drawings.

FIG. 1 is a schematic block diagram of an organic light emitting display device according to an embodiment of the present invention.

Referring to FIG. 1, the organic light emitting display device according to the embodiment of the present invention includes a timing controller 10, a scan driver 20, a data driver 30, and a display region 40.

The timing controller 10 generates a scan driving control signal SCS and a data driving control signal DCS corresponding to synchronization signals supplied from the outside. The scan driving control signal SCS generated from the timing controller 10 is supplied to the scan driver, and the data driving control signal DCS is supplied to the data driver 30. Also, the timing controller 10 supplies the data Data supplied from the outside to the data driver 30.

The scan driver 20 generates scan signals and emission control signals corresponding to the scan driving control signals SCS supplied from the timing controller 10, and supplies them to scan lines S1 to Sn+1 and emission control lines E1 to En. When the scan signals are supplied sequentially to the scan lines S1 to Sn+1, pixels 50 are selected sequentially row by row. When the emission control signals are supplied to the emission control lines E1 to En, emission of the pixels 50 is controlled.

In the embodiment of the present invention, the scan driver 20 sequentially supplies the scan signals through the scan lines S1 to Sn+1 arranged in respective horizontal lines, and supplies the emission control signal having a first voltage level (for example, a high level) to an $i^{th}$ (i is a natural number) emission control line Ei during the initial portion (e.g., a first portion) of the period when an $i^{th}$ scan signal (first scan signal) is supplied to an $i^{th}$ scan line Si and the period after the supply of an $(i+1)^{th}$ scan signal (second scan signal) to an $(i+1)^{th}$ scan line (Si+1) is completed. The emission control signal having a second voltage level (for example, a low level) is supplied to the $i^{th}$ emission control line Ei during the remaining portion of the period when the $i^{th}$ scan signal is supplied and the period when the $(i+1)^{th}$ scan signal is supplied.

The data driver 30 generates data signals corresponding to the data driving control signals DCS and the data Data supplied from the timing controller 10, and supplies them to data lines D1 to Dm. In particular, when the pixels 50 on the $i^{th}$ horizontal line are selected by the $i^{th}$ scan signal, the data driver 30 supplies the data signals for the selected pixels to the corresponding data lines D1 to Dm.

The display region 40 includes areas or regions where the scan lines S1 to Sn+1, the emission control lines E1 to En, and the data lines D1 to Dm cross one another, and includes the plurality of pixels each including an organic light emitting diode.

The respective pixels 50 are coupled to the scan lines S1 to Sn+1, the emission control lines E1 to En, and the data lines D1 to Dm, respectively horizontally or vertically, and receive the scan signals, the emission control signals, and the data signals therefrom, respectively. Such pixels emit light at brightnesses corresponding to the data signals.

Meanwhile, the pixels 50 are driven by receiving driving power, such as a high potential power ELVDD (hereinafter, referred to as a first power supply) and a low potential power ELVSS (hereinafter, referred to as a second power supply) from a power supply unit. Also, the pixels 50 may further additionally receive a reference power Vref, or other power sources, according to the circuit arrangement.

In the described embodiment of the present invention, each of the pixels 50 includes a plurality of N-type transistors that are coupled between the cathode electrode of the organic light emitting diode and the second power supply ELVSS, and supply current, adjusted corresponding to the threshold voltage of a corresponding driving transistor, to the organic light emitting diode.

When the pixel circuit includes the plurality of N-type transistors coupled between the cathode electrode of the organic light emitting diode and the second power supply ELVSS as described above, the first power supply ELVDD may be supplied to the display region, and the second power supply ELVSS may be supplied to the pixels 50 via power supply lines PL.

More detailed explanation on the arrangement and the operation of the pixels 50 as above will be described below.

Figure 2:
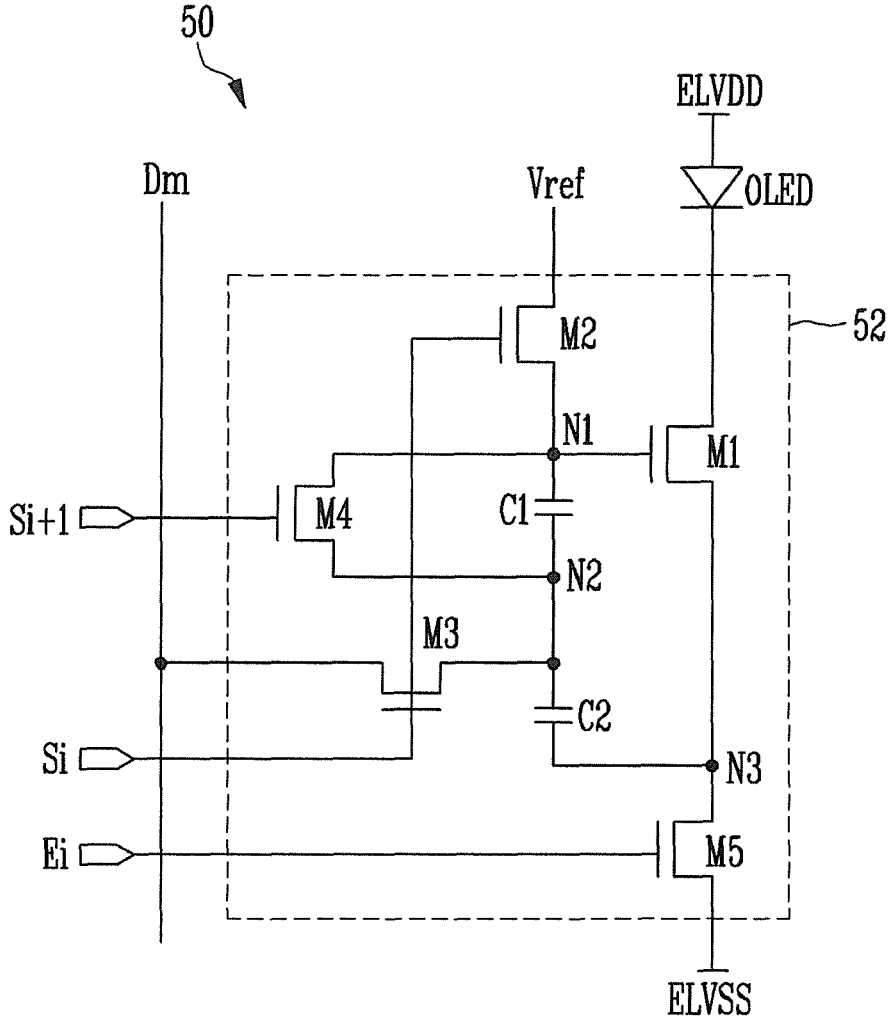
FIG. 2 is a circuit diagram showing an embodiment of a pixel of FIG. 1.

FIG. 2 is a circuit diagram showing an embodiment of the pixel of FIG. 1. For convenience, a pixel positioned on the $i^{th}$ horizontal line and coupled to the $m^{th}$ data line Dm will be described.

Referring to FIG. 2, the pixel 50 according to the embodiment includes an organic light emitting diode OLED that generates light having brightness corresponding to driving current and a pixel circuit 52 that controls the driving current that flows to the organic light emitting diode OLED.

The organic light emitting diode OLED is coupled between the first power supply ELVDD and the second power supply ELVSS. The organic light emitting diode OLED as described above emits light at a brightness corresponding to a driving current controlled by the pixel circuit 52.

To this end, the anode electrode of the organic light emitting diode OLED is coupled to the first power supply ELVDD, and the cathode electrode thereof is coupled to the second power supply ELVSS via the pixel circuit 52.

The pixel circuit 52 is coupled between the organic light emitting diode OLED and the second power supply ELVSS. The pixel circuit controls the driving current, corresponding to a data signal, flowing to the organic light emitting diode OLED during the emission period of the pixel 50.

To this end, the pixel circuit 52 includes first to fifth transistors M1 to M5 that are N-type transistors, and first and second capacitors C1 and C2. In other embodiments, some or all of the transistors may instead be P-type transistors. Those skilled in the art will recognize that the pixel circuit would be accordingly changed if P-type transistors are implemented.

The first transistor M1, which is a driving transistor, is coupled between the organic light emitting diode OLED and the second power supply ELVSS, wherein a gate electrode of the first transistor M1 is coupled to a first node N1. The first transistor M1 controls the amount of current that flows to the second power supply ELVSS from the first power supply ELVDD via the organic light emitting diode OLED, corresponding to the voltage difference between the gate electrode and a source electrode of the first transistor M1, during the emission period.

The second transistor M2 is coupled between the first node N1 and a reference power supply Vref, wherein a gate electrode of the second transistor M2 is coupled to a scan line Si (hereinafter, referred to as a first scan line). When a first scan signal (e.g., high level) is supplied to the first scan line Si, the second transistor M2 brings the first node N1 to a first voltage. In the present embodiment, the first voltage is set to the voltage of the reference power Vref.

The third transistor M3 is coupled between the data line Dm and a second node N2, wherein a gate electrode of the third transistor M3 is coupled to the first scan line Si. When the first scan signal is supplied to the first scan line Si, the third transistor M3 supplies the data signal to the second node N2.

The fourth transistor M4 is coupled between the first node N1 and the second node N2, wherein a gate electrode of the fourth transistor M4 is coupled to a next scan line Si+1 (hereinafter, referred to as a second scan line). When a second scan signal (e.g., high level) is supplied to the second scan line Si+1, the fourth transistor M4 couples the first node N1 to the second node N2.

The fifth transistor M5 is coupled between the first transistor M1 and the second power supply ELVSS, wherein a gate electrode of the fifth transistor M5 is coupled to the emission control line Ei. The fifth transistor M5 couples the first transistor M1 to the second power supply ELVSS corresponding to the emission control signal supplied to the emission control line Ei.

The first capacitor C1 is coupled between the first node N1 and the second node N2, and the second capacitor C2 is coupled between the second node N2 and a third node N3 that is a node between the first and fifth transistors M1 and M5.

Figure 3:
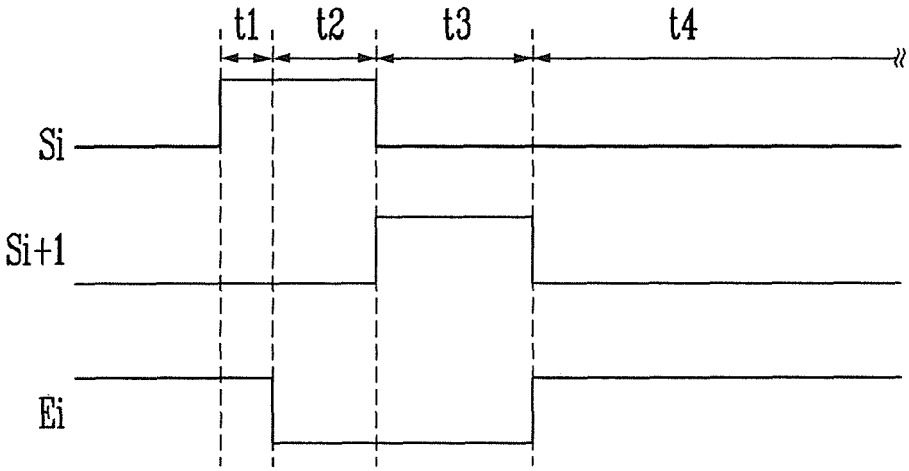
FIG. 3 is a waveform view showing waveforms of input signals input to the pixel of FIG. 2.

FIG. 3 is a waveform view showing waveforms of input signals input to the pixel of FIG. 2.

Referring to FIG. 3, the first scan signal and the second scan signal are supplied sequentially through the first scan line Si and the second scan line Si+1. Here, the first scan signal is the $i^{th}$ scan signal that is supplied to the $i^{th}$ scan line Si arranged on an $i^{th}$ horizontal line coupled to the pixel. The second scan signal is the $(i+1)^{th}$ scan signal that is supplied following the first scan signal through the $(i+1)^{th}$ scan line.

The emission control signal supplied to the emission control line Ei maintains a first voltage level (e.g., a high level) during an initial portion t1 (a first period) of the period when the first scan signal is supplied, maintains a second voltage level (e.g., a low level) during a remaining portion t2 (a second period) of the period when the first scan signal is supplied and the period t3 (a third period) when the second signal is supplied, and maintains the first voltage level during the emission period t4 (a fourth period) after the supply of the second scan signal is completed or stopped.

Here, the first voltage level is set to a voltage level where the corresponding transistor is turned on, for example, a high level. The second voltage level is set to a voltage level where the corresponding transistor is turned off, for example, a low level.

Hereinafter, the method of driving the pixel of FIG. 2 will be described in detail by applying the waveforms of the input signals of FIG. 3 to the pixel of FIG. 2.

First, during the first period, the second and third transistors M2 and M3 are turned on by the first scan signal, and the fifth transistor M5 is kept on by the emission control signal having a high level.

When the second transistor M2 is turned on, the voltage of the reference power Vref is supplied to the first node N1. At this time, the voltage of the reference power Vref is set at a voltage that can turn on the first transistor M1, that is, a voltage that is higher than the voltage of the second power supply ELVSS by at least the threshold voltage of the first transistor M1. Also, the voltage of the reference power Vref may be set at a voltage that is below or lower than the voltage of the first power supply ELVDD.

The fifth transistor M5 also maintains the turn-on state during the first period t1 as above, such that the voltage of the source electrode of the first transistor M1 is initialized to a low voltage by the second power ELVSS.

Meanwhile, when the third transistor M3 is turned on, a voltage of the data signal is transferred to the second node N2.

Thereafter, during the second period t2, the first scan signal maintains the high level, and the voltage level of the emission control signal is dropped to a low level, such that the fifth transistor M5 is turned off.

The first transistor M1 maintains the turn-on state during the initial period of the second period t2 as above, but is turned off when a voltage difference between the gate electrode and the source electrode thereof becomes the threshold voltage.

In other words, during the second period t2, the voltage of the third node N3 is charged with the voltage obtained by subtracting the threshold voltage of the first transistor M1 from the voltage of the reference power Vref, as shown in the following equation 1.

$$V(N3)=V\text{ref}-V\text{th}(M1) \quad \text{[Equation 1]}$$

In equation 1, V(N3) represents the voltage at the third node N3, Vref represents the voltage of the reference power supply, and Vth(M1) represents the threshold voltage of the first transistor M1.

At this time, the second node N2 is charged with the voltage of the data signal so that the second capacitor C2 is charged with the voltage as shown in the following equation 2.

$$V(C2)=V\text{data}-(V\text{ref}-V\text{th}(M1))=V\text{data}-V\text{ref}+V\text{th}(M1) \quad \text{[Equation 2]}$$

In equation 2, V(C2) represents the voltage stored in the second capacitor C2, and Vdata represents the voltage of the data signal.

Thereafter, during the third period t3, the fourth transistor M4 is turned on by the second scan signal having a high level.

If the fourth transistor M4 is turned on, the first node N1 is coupled to the second node N2 so that the voltage stored in the first capacitor C1 is set to 0 and the voltage between the gate electrode and source electrode of the first transistor M1 is set to the voltage charged in the second capacitor C2 as shown in the following equation 3.

$$V\text{gs}(M1)=V\text{data}-V\text{ref}+V\text{th}(M1) \quad \text{[Equation 3]}$$

In equation 3, Vgs (M1) represents the voltage between the gate electrode and source electrode of the first transistor M1.

Thereafter, during the fourth period t4, the voltage level of the emission control signal is raised to the high level, such that the fifth transistor M5 is turned on.

Then, the current path of the driving current that flows to the second power supply ELVSS from the first power supply ELVDD via the organic light emitting diode OLED and the first and fifth transistors M1 and M5 is formed.

At this time, the driving current that flows through the organic light emitting diode OLED is determined by the voltage Vgs (M1) between the gate electrode and source electrode of the first transistor M1, as shown in the following equation 4.

$$I_{OLED}=\beta(V\text{gs}(M1)-V\text{th}(M1))^2=\beta((V\text{data}-V\text{ref}+V\text{th}(M1))-V\text{th}(M1))^2=\beta(V\text{data}-V\text{ref})^2 \quad \text{[Equation 4]}$$

In equation 4, $I_{OLED}$ represents the driving current that flows through the organic light emitting diode OLED, and β represents a constant value related to a process transconductance parameter $\mu_n C_{ox}$ and an aspect ratio W/L of the first transistor M1.

Referring to equation 4, the driving current that flows through the organic light emitting diode OLED is determined by the difference between the voltage of the data signal and the voltage of the reference power Vref. Here, the voltage of the reference power Vref is a fixed voltage such that the driving current is determined to be uniform for the data signal corresponding to each brightness level, irrespective of variations in the threshold voltages of the first transistors M1.

With the pixel 50 as described above, relatively fewer transistors are utilized to compensate for the threshold voltage of the driving transistor (first transistor M1), for displaying a uniform image irrespective of the variations of the threshold voltage of the driving transistor and to improve image quality. Also, the pixel 50 determines the driving current corresponding to the voltage of the reference power Vref rather than the voltage of the first or second power supply ELVDD or ELVSS, such that the image quality may not be non-uniform due to a voltage drop from the first and second power supplies ELVDD and ELVSS across the display device.

Also, with the pixel 50 as described above, the source electrode of the first transistor M1 can be effectively initialized by controlling the timing of the emission control signal. While a voltage that can offset the threshold voltage of the first transistor M1 is stored between the gate electrode and the source electrode of the first transistor M1, the emission of the pixel 50 can be controlled by, for example, preventing or reducing the emission of the pixel 50 and/or controlling the duration of the emission period, etc. Therefore, power consumption can be improved and furthermore, a blurring phenomenon where a screen is blurred can be prevented or reduced.

Figure 4:
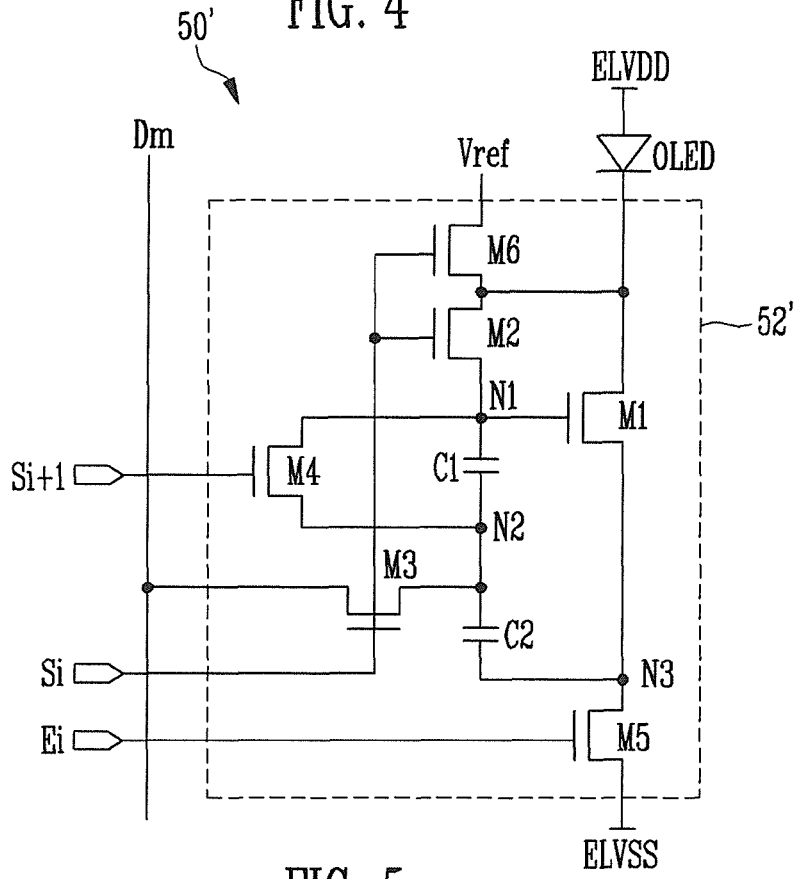
FIG. 4 is a circuit diagram showing another embodiment of the pixel of FIG. 1.

FIG. 4 is a circuit diagram showing another embodiment of a pixel of FIG. 1. When explaining FIG. 4, the same features as features described in the embodiment of FIG. 2 will be provided with the same reference numerals, and a detailed description thereof will be omitted.

Referring to FIG. 4, a pixel 50' according to the present embodiment is coupled between the reference power supply Vref and the cathode electrode of the organic light emitting diode OLED, and further includes a sixth transistor M6 whose gate electrode is coupled to the first scan line Si. Here, the sixth transistor M6 may be implemented using the same type transistor as that in the first to fifth transistors M1 to M5, for example, an N-type transistor.

When the first scan signal is supplied, the sixth transistor M6 transfers the voltage form the reference power supply Vref (e.g., a first voltage) to the cathode electrode of the organic light emitting diode OLED.

The pixel 50' according to the present embodiment, which further includes the sixth transistor M6, prevents or reduces overcurrent from abruptly flowing to the organic light emitting diode OLED during the period when the first scan signal is supplied (in particular, the first period t1 in FIG. 3). The pixel 50' may control the emission of the organic light emitting diode OLED by controlling the voltage of the reference power Vref.

In particular, if the difference between the voltage of the reference power Vref and the voltage of the first power ELVDD is set below the threshold voltage of the organic light emitting diode OLED, where the voltage of the reference power Vref falls within the voltage range set in the embodiment of FIG. 2, the emission of the organic light emitting diode OLED can be effectively prevented or minimized during the period when the first scan signal is supplied.

Figure 5:
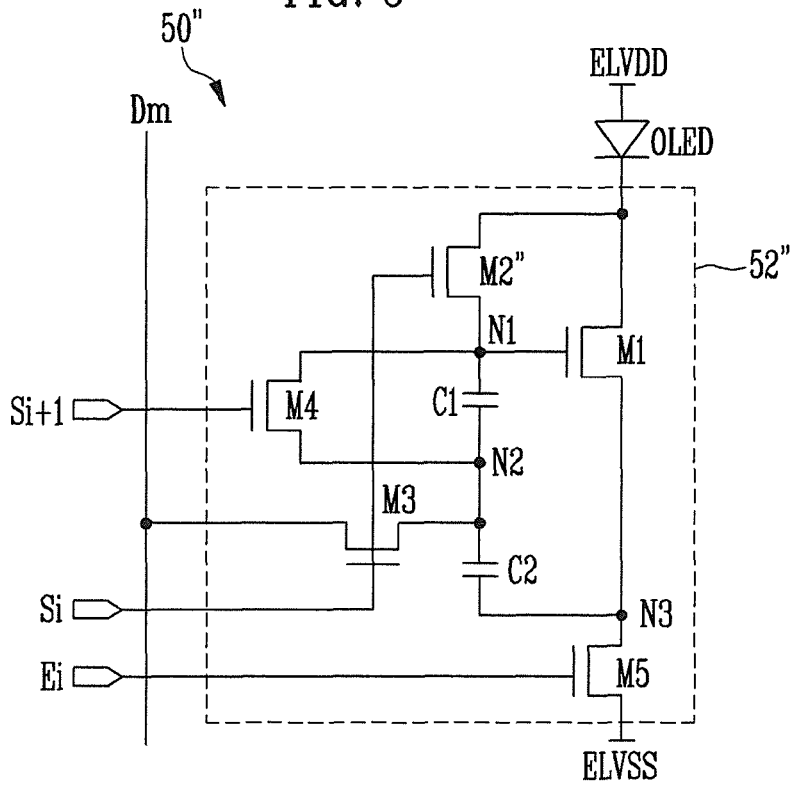
FIG. 5 is a circuit diagram showing another embodiment of the pixel of FIG. 1.

FIG. 5 is a circuit diagram showing another embodiment of a pixel of FIG. 1. When explaining FIG. 5, the same features as features described in the embodiment of FIG. 2 will be provided with the same reference numerals, and a detailed description thereof will be omitted.

Referring to FIG. 5, a second transistor M2" of a pixel 50" is coupled between the cathode electrode of the organic light emitting diode OLED and the first node N1.

In other words, in the present embodiment, one electrode of the second transistor M2" is coupled to the first node N1 and a gate electrode of the second transistor M2" is coupled to the first scan line Si in the same manner as described with respect to the embodiment of FIG. 2, but the other electrode of the second transistor M2" is coupled to the cathode electrode of the organic light emitting diode OLED rather than a reference power supply Vref.

When the first scan signal is supplied to the first scan line Si, the second transistor M2" as described above transfers a first voltage to the first node N1. Here, current flows via the organic light emitting diode OLED during the first period t1 of FIG. 3, so that the first voltage is set to have a value corresponding to subtracting the threshold voltage of the organic light emitting diode OLED from the voltage of the first power ELVDD.

Hereinafter, the method of driving the pixel of FIG. 5 will be described by applying the waveforms of the input signals of FIG. 3 to the pixel of FIG. 5.

First, during the first period t1, the second and third transistors M2" and M3 are turned on by the first scan signal having a high level, and the fifth transistor M5 is kept on by the emission control signal having a high level.

When the fifth transistor M5 is on, there occurs an abrupt flow of current from the first power supply ELVDD to the second power supply ELVSS, and the voltage of the source electrode of the first transistor M1 is initialized to a low voltage by the second power supply ELVSS.

When the second transistor M2" is turned on, the voltage of the cathode electrode of the organic light emitting diode OLED is transferred to the first node N1. In other words, in the present embodiment, the first voltage transferred to the first node N1 by the second transistor M2" is set to ELVDD−Vto, corresponding to subtracting the threshold voltage of the organic light emitting diode OLED (hereinafter, Vto) from the voltage of the first power ELVDD.

Meanwhile, when the third transistor M3 is turned on, the voltage of the data signal is transferred to the second node N2.

Thereafter, during the second period t2, the first scan signal maintains a high level and the voltage level of the emission control signal is dropped to a low level, such that the fifth transistor M5 is turned off.

During the initial portion of the second period t2, as above, the first transistor M1 maintains a turn-on state and then is turned off when a voltage difference between the gate electrode and the source electrode becomes the threshold voltage.

In other words, during the second period t2, the voltage of the third node N3 is brought to a voltage obtained by subtracting the threshold voltage Vth(M1) of the first transistor M1 from the voltage ELVDD−Vto from the first node N1, as shown in the following equation 5.

$$V(N3)=(\mathrm{ELVDD}-V\mathrm{to})-V\mathrm{th}(M1) \quad \text{[Equation 5]}$$

At this time, the second node N2 is charged with a voltage of the data signal so that the second capacitor C2 is charged with the voltage as shown in the following equation 6.

$$V(C2)=V\mathrm{data}-((\mathrm{ELVDD}-V\mathrm{to})-V\mathrm{th}(M1))=V\mathrm{data}-\mathrm{ELVDD}+V\mathrm{to}+V\mathrm{th}(M1) \quad \text{[Equation 6]}$$

Thereafter, during the third period t3, the fourth transistor M4 is turned on by the second scan signal having a high level.

If the fourth transistor M4 is turned on, the first node N1 is coupled to the second node N2 so that the voltage stored in the first capacitor C1 is set to 0, and the voltage between the gate electrode and source electrode of the first transistor M1 is set to the voltage charged in the second capacitor C2 as shown in the following equation 7.

$$V\mathrm{gs}(M1)=V\mathrm{data}-\mathrm{ELVDD}+V\mathrm{to}+V\mathrm{th}(M1) \quad \text{[Equation 7]}$$

Thereafter, during the fourth period t4, the voltage level of the emission control signal is raised to the high level, such that the fifth transistor M5 is turned on.

Then, the current path of the driving current that flows to the second power supply ELVSS from the first power supply ELVDD via the organic light emitting diode OLED and the first and fifth transistors M1 and M5 is formed.

At this time, the driving current that flows to the organic light emitting diode OLED is determined by the voltage Vgs (M1) between the gate electrode and source electrode of the first transistor M1, as shown in the following equation 8.

$$I_{OLED}=\beta(Vgs(M1)-Vth(M1))^2=\beta((Vdata-ELVDD+Vto+Vth(M1))-Vth(M1))^2=\beta(Vdata-ELVDD+Vto)^2 \quad \text{[Equation 8]}$$

Referring to equation 8, the driving current that flows to the organic light emitting diode OLED is determined by the voltage of the data signal, the voltage of the first power supply ELVDD, and the threshold voltage of the organic light emitting diode. Here, the voltage of the first power supply ELVDD and the threshold voltage of the organic light emitting diode are fixed voltages such that the driving current is determined to be uniform for the data signal corresponding to each brightness level, irrespective of variations in the threshold voltages of the first transistors M1.

With the pixel 50" as described above, relatively fewer transistors are utilized, and a separate reference power supply (Vref in the previously described embodiments) is not utilized for compensating for the threshold voltage of the driving transistor (first transistor M1). Therefore, the pixel 50" displays a uniform image, irrespective of variations in the threshold voltages of the driving transistors of the pixels, and thereby improving image quality.

Also, with the pixel 50" as described above, the emission of the pixel 50" is easily controlled in a similar manner as with the pixels 50 and 50' in the previously described embodiments, thereby improving power consumption and further preventing or reducing the blurring phenomenon where the screen is blurred.

Meanwhile, the pixel 50" according to the present embodiment can be usefully applied to a structure where the voltage drop from the first power supply ELVDD can be easily prevented or reduced. For example, an electrode plate that supplies the first power supply ELVDD can be formed of conductive material having low specific resistance, and a rear emitting structure can be designed relatively free from thickness restrictions, for example.

Figure 6:
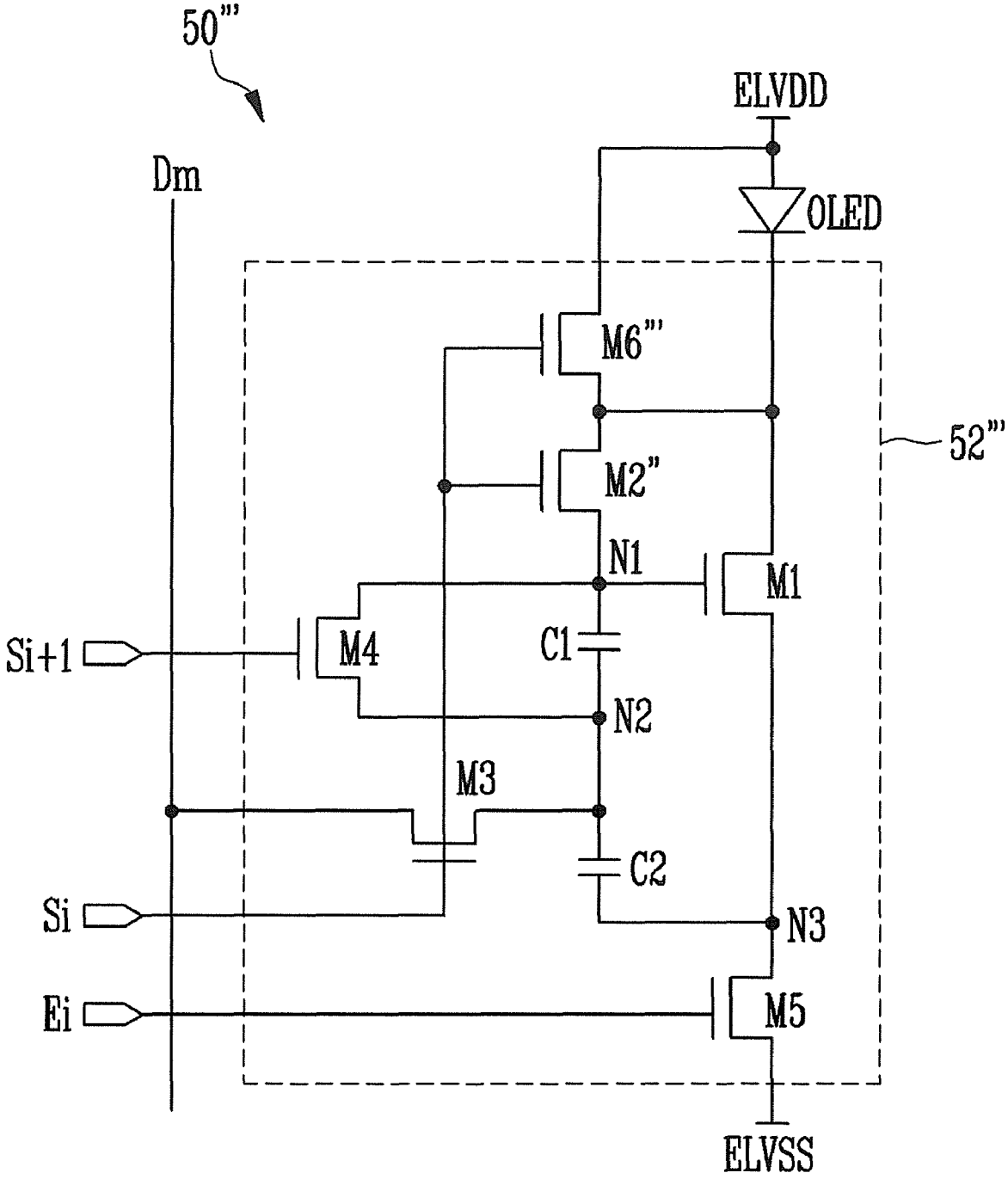
FIG. 6 is a circuit diagram showing another embodiment of the pixel of FIG. 1.

FIG. 6 is a circuit diagram showing another embodiment of a pixel of FIG. 1. When explaining FIG. 6, the same features as features described in the embodiment of FIG. 5 will be provided with the same reference numerals and the detailed description thereof will be omitted.

Referring to FIG. 6, a pixel 50''' is coupled between the anode electrode and the cathode electrode of the organic light emitting diode OLED, and further includes a sixth transistor M6''' whose gate electrode is coupled to the first scan line Si. Here, the sixth transistor M6''' may be implemented using the same type transistor as that in the first to fifth transistors M1 to M5, for example, an N-type transistor.

When the first scan signal is supplied, the sixth transistor M6''' couples the anode electrode of the organic light emitting diode OLED to the cathode electrode thereof. In other words, while the first signal is supplied, the anode electrode and the cathode electrode of the organic light emitting diode OLED are at substantially a same voltage.

Therefore, in the present embodiment, while the first scan signal is supplied, the emission of the organic light emitting diode OLED can be effectively prevented or minimized.

Meanwhile, in the pixel 50''' according to the present embodiment, the voltage of the first power ELVDD is transferred to the first node N1 while the first scan signal is supplied, in contrast to the pixel 50" in the embodiment of FIG. 5. In other words, in the present embodiment, a first voltage that is transferred to the first node N1 by the sixth transistor M6''' is set as the voltage of the first power supply ELVDD.

Therefore, during the third period t3 of FIG. 3, the voltage between the gate electrode and the source electrode of the first transistor M1 of the pixel 50''' according to the present embodiment is represented in the form where the threshold voltage Vto of the organic light emitting diode OLED is removed from equation 7, as shown in the following equation 9.

$$Vgs(M1)=Vdata-ELVDD+Vth(M1) \quad \text{[Equation 9]}$$

Therefore, a driving current that flows to the organic light emitting diode OLED during the fourth period t4 of FIG. 3, that is, during the emission period, is represented by the following equation 10.

$$I_{OLED}=\beta(Vgs(M1)-Vth(M1))^2=\beta((Vdata-ELVDD+Vth(M1))-Vth(M1))^2=\beta(Vdata-ELVDD)^2 \quad \text{[Equation 10]}$$

The pixel 50''' according to the embodiment as described above prevents or reduces emission of the organic light emitting diode OLED during the non-emission period, in addition to the other features provided by the pixel 50" in the embodiment of FIG. 5.

While the present invention has been described in connection with certain exemplary embodiments, it is to be understood that the invention is not limited to the disclosed embodiment, but is instead intended to cover various modifications and equivalent arrangements included within the spirit and scope of the appended claims, and equivalents thereof.

What is claimed is:

1. A pixel comprising:

an organic light emitting diode coupled between a first power supply and a second power supply, the first power supply having a higher voltage than the second power supply;

a first transistor coupled between the organic light emitting diode and the second power supply, and for controlling a driving current that flows from the first power supply to the second power supply via the organic light emitting diode;

a second transistor coupled to a first node to which a gate electrode of the first transistor is coupled, and for bringing the first node to a first voltage in accordance with a first scan signal;

a first capacitor coupled between the first node and a second node;

a third transistor coupled between the second node and a data line, and for supplying a data signal from the data line to the second node in accordance with the first scan signal;

a fourth transistor coupled between the first node and the second node, and for coupling the first node to the second node in accordance with a second scan signal;

a fifth transistor coupled between the first transistor and the second power supply, and for coupling the first transistor to the second power supply in accordance with an emission control signal; and a second capacitor coupled between the second node and a third node between the first transistor and the fifth transistor.

2. The pixel as claimed in claim 1, wherein the first scan signal is an $i^{th}$ (i is a natural number) scan signal supplied through an $i^{th}$ scan line to which the pixel is coupled, and the second scan signal is an $(i+1)^{th}$ scan signal supplied through an $(i+1)^{th}$ scan line after the first scan signal is supplied.

3. The pixel as claimed in claim 2, wherein the emission control signal is at a voltage for turning on the fifth transistor during an initial portion of a period when the first scan signal is supplied, is at a voltage for turning off the fifth transistor during a remaining portion of the period when the first scan signal is supplied and during a period when the second scan signal is supplied, and is at the voltage for turning on the fifth transistor after the period when the second scan signal is supplied.

4. The pixel as claimed in claim 1, wherein the first to fifth transistors are N-type transistors.

5. The pixel as claimed in claim 1, wherein the second transistor is coupled to a reference power supply and the first voltage is a voltage of the reference power supply.

6. The pixel as claimed in claim 5, wherein the first voltage is higher than a voltage of the second power supply by at least a threshold voltage of the first transistor and lower than a voltage of the first power supply.

7. The pixel as claimed in claim 5, further comprising a sixth transistor coupled between the reference power supply and a cathode electrode of the organic light emitting diode, and for transmitting the first voltage to the cathode electrode of the organic light emitting diode when the first scan signal is supplied.

8. The pixel as claimed in claim 7, wherein the first voltage is higher than a voltage of the second power supply by at least a threshold voltage of the first transistor and lower than a voltage of the first power supply, wherein a voltage difference between the first voltage and the voltage of the first power supply is lower than a threshold voltage of the organic light emitting diode.

9. The pixel as claimed in claim 1, wherein the second transistor is coupled between the first node and a cathode electrode of the organic light emitting diode.

10. The pixel as claimed in claim 9, wherein the first voltage is a voltage of the first power supply subtracted by the threshold voltage of the organic light emitting diode.

11. The pixel as claimed in claim 9, further comprising a sixth transistor coupled between an anode electrode of the organic light emitting diode and the cathode electrode of the organic light emitting diode, and for coupling the anode electrode of the organic light emitting diode to the cathode electrode of the organic light emitting diode when the first scan signal is supplied.

12. The pixel as claimed in claim 11, wherein the first voltage is the voltage of the first power supply.

13. An organic light emitting display device, comprising a display region comprising a plurality of pixels, wherein each of the plurality of pixels comprises:

an organic light emitting diode coupled between a first power supply and a second power supply, the first power supply having a higher voltage than the second power supply;

a first transistor coupled between the organic light emitting diode and the second power supply, and for controlling a driving current that flows from the first power supply to the second power supply via the organic light emitting diode;

a second transistor coupled to a first node to which a gate electrode of the first transistor is coupled, and for bringing the first node to a first voltage in accordance with a first scan signal;

a first capacitor coupled between the first node and a second node;

a third transistor coupled between the second node and a data line, and for supplying a data signal from the data line to the second node in accordance with the first scan signal;

a fourth transistor coupled between the first node and the second node, and for coupling the first node to the second node in accordance with a second scan signal;

a fifth transistor coupled between the first transistor and the second power supply, and for coupling the first transistor to the second power supply in accordance with an emission control signal; and a second capacitor coupled between the second node and a third node between the first transistor and the fifth transistor.

14. The organic light emitting display device as claimed in claim 13, further comprising:

a scan driver for sequentially supplying the first scan signal and the second scan signal to the plurality of pixels; and a data driver for supplying the data signal to corresponding pixels of the plurality of pixels when the first scan signal is supplied.

15. The organic light emitting display device as claimed in claim 14, wherein the scan driver further supplies the emission control signal, and wherein the emission control signal is at a voltage for turning on the fifth transistor during an initial portion of a period when the first scan signal is supplied and after a period when the second scan signal is supplied, and is at a voltage for turning off the fifth transistor during a remaining portion of the period when the first scan signal is supplied and during the period when the second scan signal is supplied.

16. The organic light emitting display device as claimed in claim 13, wherein the second transistor is coupled to a reference power supply and the first voltage is a voltage of the reference power supply.

17. The organic light emitting display device as claimed in claim 16, wherein each of the plurality of pixels further comprises a sixth transistor coupled between the reference power supply and a cathode electrode of the organic light emitting diode, and for transmitting the first voltage to the cathode electrode of the organic light emitting diode when the first scan signal is supplied.

18. The organic light emitting display device as claimed in claim 13, wherein the second transistor is coupled between the first node and a cathode electrode of the organic light emitting diode.

19. The organic light emitting display device as claimed in claim 18, wherein each of the plurality of pixels further comprises a sixth transistor coupled between an anode electrode of the organic light emitting diode and the cathode electrode of the organic light emitting diode, and for coupling the anode electrode of the organic light emitting diode to the cathode electrode of the organic light emitting diode when the first scan signal is supplied.

* * * * *